United States Patent [19]

Hawkins

[11] 4,077,343

[45] Mar. 7, 1978

[54] TUFTING METHOD OF REDUCING YARN WASTES DURING THE TUFTING PROCESS

[75] Inventor: James W. Hawkins, Calhoun, Ga.

[73] Assignee: Wellco Carpet Corporation, Calhoun, Ga.

[21] Appl. No.: 686,673

[22] Filed: May 14, 1976

[51] Int. Cl.[2] ..... D05C 17/02

[52] U.S. Cl. ..... 112/410; 112/266

[58] Field of Search ..... 112/410, 409, 411, 266, 112/79 R, 79 A, 78; 57/139, 140 R, 140 BY; 28/76 T, 74 P

[56] References Cited

U.S. PATENT DOCUMENTS

| | | | |
|---|---|---|---|
| 1,310,902 | 7/1919 | Ayres | 28/74 P |
| 2,001,527 | 5/1935 | Davison | 28/74 P |
| 2,420,960 | 5/1947 | Larkin | 28/76 T |
| 3,359,934 | 12/1967 | Schwartz et al. | 112/410 |
| 3,875,883 | 4/1975 | Eberwein et al. | 112/79 A |
| 3,975,562 | 8/1976 | Madebach et al. | 112/410 X |

*Primary Examiner*—H. Hampton Hunter

*Attorney, Agent, or Firm*—Cushman, Darby & Cushman

[57] ABSTRACT

The present invention is directed to an improved and more economical tufting process and a novel product resulting therefrom. The yarn employed in the trimmable selvage portion of the tufted carpet comprises any type of waste yarn which is capable of being tufted but would otherwise be discarded or used to produce candy stripe carpeting. Thus, the selvage portion is produced from low cost waste yarn rather than from first quality yarn used to produce the main or central portion of the carpet.

9 Claims, 3 Drawing Figures

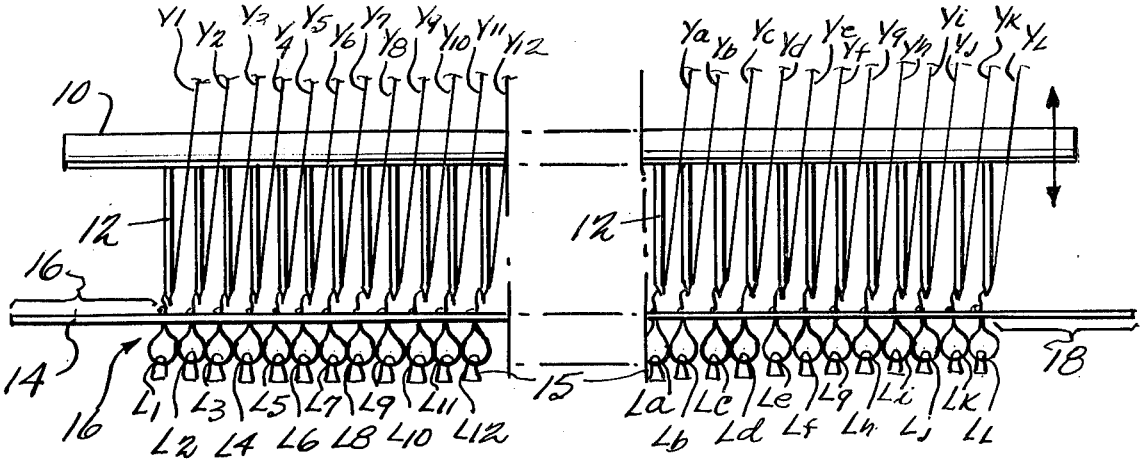
Fig. 1
Fig. 2
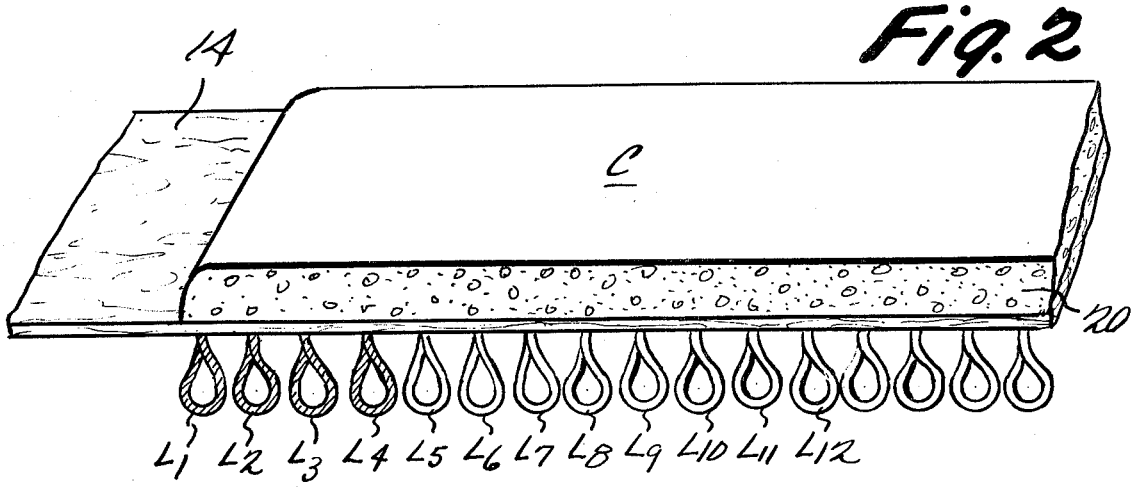
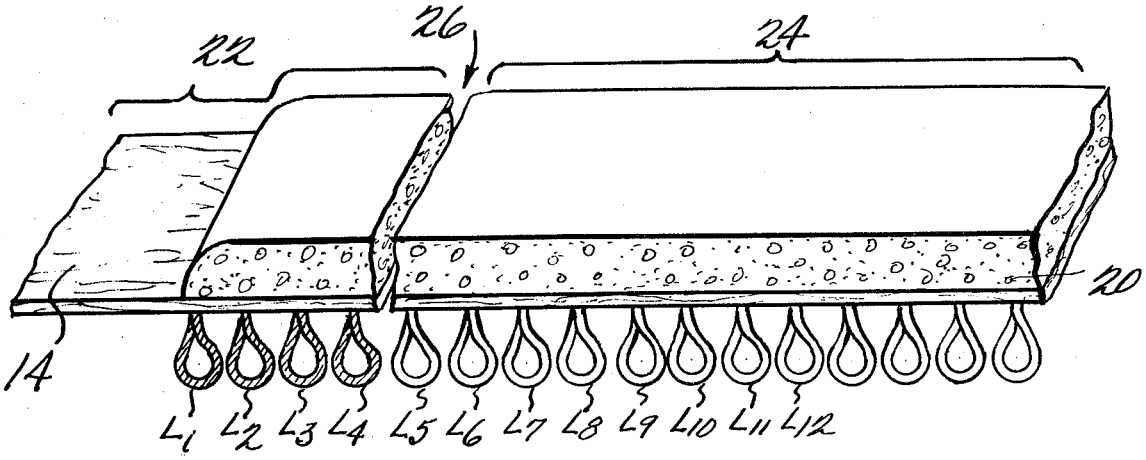
Fig. 3

TUFTING METHOD OF REDUCING YARN WASTES DURING THE TUFTING PROCESS

BACKGROUND OF THE INVENTION

This invention relates to a method for producing a greater amount of a tufted pile fabric and more particularly to an improved method of producing a novel article of manufacture more economically.

It will be understood that, in the tufting of pile fabric and particularly carpets, a series of needles are positioned in a needle bar and carry the pile yarns through a backing fabric which is advanced over a throat, oscillating loopers positioned underneath the throat engage the pile yarns and the loopers may be positioned to provide cut pile or uncut pile as may be desired.

Further, the use of tufting machines has become widespread because of their vastly higher speeds and thus their ability to produce greater lengths of carpet. Yet for all their speed, the amount of yarn consumed and waste yarn has also increased.

In conventional tufting processes the width of the needles being threaded will usually be wider than the width desired for the finished carpet. Further, each of the needles in the needle bar is threaded with the same quality yarn as is used throughout the entire carpet being tufted.

Likewise, it is conventional for the backing material to be wider than the area being tufted so that a portion of the backing material along each side of the carpet remains free of carpet yarn. While this portion of the backing material is used to hold the carpet during subsequent finishing operations, this material must be trimmed away from both sides of the carpet before the carpet itself is ready for sale. During this trimming process, several tufted rows of carpet yarn along the entire length of each edge are also trimmed away so as to produce the desired width for the finished carpet.

As indicated the width of the backing material is somewhat wider than the desired width of the finished carpet, which generally is between twelve to fifteen feet. The extra width is provided so that the tufted carpet can be conveniently held by tentering frames or other finishing equipment as for example during the application and curing of laytex or other binder materials to the back of the carpet and also during the application of secondary backing materials.

Following the last finishing step and prior to the carpet being prepared for shipment, the edges or selvage portions along each side of the carpet are trimmed by trimming devices which generally are circular knives. These knives are positioned at each edge of the selvage and are adjusted so as to not only trim off the excess width of the backing material but also to trim away the excess rows of the tufted yarn so as to achieve the desired finished carpet width and to form smooth straight edges. Since the amount of the tufted portion which is trimmed will usually vary between one and three percent of the original carpet area, the trimming step wastes a great deal of first quality yarn. Thus, the primary object of the present invention is to reduce the amount of first quality yarn wasted due to selvage trimming.

The present invention accomplishes the primary objective by making use of carpet yarn which for any reason could be considered to be waste yarn. The only essential requirement would be that such waste yarn must exhibit sufficient strength to be tuftable.

In many instances yarn from different dye lots will be leftover. This is so since yarn dyeing is conventionally done in a batch operation. Thus, while desirable it is sometimes difficult to reproduce the exact shade from batch to batch making it often impossible to use yarns dyed in different dye lots in a continuous tifting process. If the yarns were mixed, slight color variations would remove the completed tufted carpet from a first quality status. Thus, with each dye lot there is some amount of leftover yarn which cannot be used to produce sufficiently long lengths of tufted carpets.

In other instances, the amount of yarn dyed to fulfill carpet orders will exceed the amount of yarn necessary to complete the order, or the yarn may have been incorrectly dyed or in some other way improperly prepared. For whatever reason, however, a certain amount of yarn waste is a necessary part of carpet tufting operations.

As a result, yarn which might otherwise be first quality yarn becomes low cost leftover waste yarn. Traditionally, such yarn is saved and when a sufficient amount has been collected, a carpet referred to as candy stripe will be made from such yarn. Since yarns of numerous colors and types are used, such carpeting is usually sold at a much reduced price.

In the present invention, this cost cost waste yarn which is collected from previous tufting operations is used to thread those needles in the needle bar which will produce rows of tufted loops forming part of the selvage of the carpet. Since the selvage portion is discarded, economics of production are realized if the discarded portion contains low cost waste yarn rather than the relatively high cost first quality yarn.

For a more detailed understanding of the invention, reference is now made to the following description of the preferred method and product and to the accompanying drawings in which:

FIG. 1 is a diagrammatic cross-sectional view of a portion of a tufting machine showing the thread up of needles on each side of the needle bar;

FIG. 2 is a diagrammatic cross-section of one edge of the resulting product prior to trimming;

FIG. 3 is a diagrammatic cross-section of one edge of the resulting carpet immediately subsequent to trimming.

With reference now to FIG. 1, a needle bar 10 is provided with a plurality of needles 12 mounted therein. The needle bar 10 and associated needles 12 are vertically movable as indicated by the arrows by conventional drive means (not shown). The position of the needle bar 10 in FIG. 1 is raised prior to its being lowered into a tufting position at which point each of the needles will be forced to pierce through the primary backing material 14 to a uniform distance. Tuft loops generally indicated at 16 can either be cut or remain uncut and are formed from the yarns $Y_1$-$Y_{12}$ and $Y_a$-$Y_L$ threaded through needles 12 by means of loopers 15, one of which will engage each needle and yarn underneath the backing material 14 so as to hold the yarn while the needle bar 10 is retracted to the position shown in FIG. 1. Since the formation of such tuft loops does not form part of this invention and can be accomplished by a variety of conventional methods, further discussion is not deemed to be essential for purposes of describing the preferred embodiment of the present invention to one skilled in the art.

Conventionally, each of the yarns $Y_1$-$Y_{12}$ and $Y_a$-$Y_L$ fed to needles 12 would all be of the same type and quality yarn that was to appear in the finished carpet and produce loops $L_1$-$L_{12}$ and $L_a$-$L_L$. The backing material 14 which extends beyond either side of the needle bar 10 as indicated by brackets 16 and 18 is not provided with any loops and is used as indicated previously during subsequent processing stages to support the carpet and is usually engaged by clamps or pins, as for example when the carpet is moved through a tenter frame used for curing secondary backing materials onto the finished carpet. At the conclusion of such subsequent processing steps, however, this portion of the carpet must be trimmed off so as to place the carpet in its final form ready for sale and installation.

FIG. 2 shows one edge of the carpet C after a secondary backing material such as foam 20 has been applied but before the selvage has been trimmed. Normally such foam backings are comprised of a polyurethane or other synthetic or natural foams. In addition, other secondary backing materials such as jute or woven polypropylene can also be used.

FIG. 3 shows the final stage of production where the selvage portion of the carpet C, indicated by the bracket at 22, has been trimmed from the main portion of the carpet C as indicated by bracket 24 along the trim line generally indicated at 26.

As is shown in FIG. 3, the selvage portion 22 of the carpet is comprised of the extra backing material 14 at the side of the carpet and also rows containing loops $L_1$-$L_4$ formed from yarns $Y_1$-$Y_4$. The portion of the finished carpet shown in FIG. 3 is comprised of loops $L_5$-$L_{11}$ formed from yarns $Y_5$-$Y_{12}$ with one edge of the finished carpet running along the row of loops $L_5$.

In carrying out the present invention, the loops contained in the selvage portions 22 shown in FIG. 3, $L_1$-$L_4$, are formed from waste yarns. Thus, in FIG. 1, if the selvage was to be comprised of the outer four rows of loops on each side of the carpet, the outer four needles 12 on the needle bar 10 would be threaded with waste yarn. In other words, yarns $Y_1$-$Y_4$ and $Y_f$-$Y_L$, as shown in FIG. 1, will be waste yarns while yarns $Y_5$-$Y_{12}$ and $Y_a$-$Y_g$, together with the yarns therebetween, will be first quality yarns.

In this manner, the amount of first quality yarn that would otherwise be used to form the rows of loops $L_1$-$L_4$ can now be used to form the loops that will appear in the finished carpet such as loops $L_5$-$L_{12}$, thereby allowing greater lengths of first quality finished carpet to be produced. Further, great savings can result by employing waste yarn normally encountered in carpet operations in replacing first quality yarn in the selvage portion of carpets.

As was indicated previously, the selvage portion 22 which is trimmed away from the final finished carpet will vary between one and three percent of the total area of tufted carpets. Thus, from one to three percent extra finished carpet can be produced by not having to employ the first quality carpet yarns in the selvage portion thereof.

While the present application refers to a selvage area which is comprised of four rows of loops on each side of a tufted carpet it should be understood that the number of rows of loops comprising the selvage portion of carpets can vary. Likewise, while the height of loops $L_1$-$L_{11}$ have been shown as being uniform, it is well within the contemplation of this application that the loops could be of varying heights, cut or uncut, or various combinations thereof depending upon the style of the particular carpet being manufactured.

It will now be clear that there is provided herein the description of a novel process and article of manufacture which accomplishes the objectives heretofore set forth. While the present invention has been disclosed in a preferred form, it should be understood that the specific embodiment thereof as described and illustrated herein is not to be considered in a limited sense as there may be other forms and modifications of the present invention which should also be construed to come within the scope of the appending claims.

What is claimed is:

1. In a process for tufting carpets wherein a plurality of yarns are threaded to at least one vertically reciprocating needle bar provided with a plurality of needles, primary backing material is moved past the needle bar as the needle bar is reciprocated so as to form tuft loops thereby, and wherein the yarn is suitably retained in the backing material following each reciprocation of the needle bar, the improvement comprising the steps of: threading a predetermined number of the outer needles in the needle bar which produce the selvage portion of the carpet with a low cost yarn and threading the remaining needles in the needle bar between said predetermined outer needles with a first quality yarn wherein the first quality yarn is that yarn which is to appear in the finished carpet.

2. A process as in claim 1 wherein the low cost of yarn is waste yarn.

3. A process as in claim 1 further including the steps of placing a secondary backing on the bottom side of the primary backing tufted with the low cost and first quality yarns and bonding the secondary backing to the primary backing.

4. A new article of manufacture comprised of:

a layer of primary backing material having a predetermined length and width;

a plurality of rows of yarns retained within said primary backing material, said rows extending across a predetermined portion of the width of said primary backing material and along the length thereof;

wherein a predetermined number of the outer rows within said rows of yarns are comprised of waste yarn and the rows between said predetermined number of outer rows are comprised of non-waste yarn.

5. A new article of manufacture as in claim 4 further including a layer of secondary backing material secured to the bottom surface of said layer of primary backing material.

6. A new article of manufacture as in claim 5 wherein said layer of secondary backing material extends over at least that portion of the bottom surface of said layer of primary backing material in which said rows of yarns are retained.

7. A new article of manufacture as in claim 6 wherein said secondary backing material is jute.

8. A new article of manufacture as in claim 6 wherein said secondary backing material is a synthetic material.

9. A new article of manufacture as in claim 8 wherein said synthetic material is expanded polyurethane.

* * * * *